US007607199B2

(12) United States Patent
Sprague

(10) Patent No.: US 7,607,199 B2
(45) Date of Patent: Oct. 27, 2009

(54) FRAMELESS GLASS DOOR HINGE

(75) Inventor: Gary Sprague, Los Angeles, CA (US)

(73) Assignee: C.R. Laurence Company, Inc., Los Angeles, CA (US)

( * ) Notice: Subject to any disclaimer, the term of this patent is extended or adjusted under 35 U.S.C. 154(b) by 150 days.

(21) Appl. No.: 11/151,800

(22) Filed: Jun. 13, 2005

(65) Prior Publication Data

US 2006/0277716 A1 Dec. 14, 2006

(51) Int. Cl.
*E05D 5/02* (2006.01)

(52) U.S. Cl. ..... 16/252

(58) Field of Classification Search ..... 16/252, 16/238, 240, 245, 246; 4/610, 607, 605, 4/614

See application file for complete search history.

(56) References Cited

U.S. PATENT DOCUMENTS

| | | | | |
|---|---|---|---|---|
| 1,312,667 | A | 8/1919 | Ayres | |
| 1,318,824 | A | 10/1919 | Alary | |
| 1,439,703 | A | 12/1922 | Hauenstein | |
| 2,284,074 | A | 5/1942 | Stahl | |
| 2,595,187 | A * | 4/1952 | Carlson | 16/245 |
| 2,661,495 | A | 12/1953 | Kalleberg | |
| 2,717,413 | A * | 9/1955 | Freschner | 16/238 |
| 3,083,402 | A | 4/1963 | Foltz | |
| 3,325,942 | A * | 6/1967 | Bejarano | 49/381 |
| 3,378,881 | A | 4/1968 | Hentzi et al. | |
| 3,390,486 | A | 7/1968 | Walters | |
| 3,546,736 | A | 12/1970 | Booth | |
| 3,628,845 | A | 12/1971 | Grimm | |
| 3,648,327 | A | 3/1972 | Edeus | |
| 3,722,031 | A | 3/1973 | Bourgeois | |
| 3,858,274 | A | 1/1975 | Burton et al. | |
| 3,866,658 | A * | 2/1975 | Smtih | 160/206 |
| 3,932,913 | A * | 1/1976 | Johnson | 16/245 |

(Continued)

OTHER PUBLICATIONS

Somaca, "General Installation Information", (date not known, at least as early as 2002).

*Primary Examiner*—Victor Batson
*Assistant Examiner*—Matthew Sullivan
(74) *Attorney, Agent, or Firm*—Mitchell P. Brook; Luce, Forward, Hamilton & Scripps LLP

(57) ABSTRACT

A pivot door hinge assembly includes a clamp housing, wedge, and base plate. The clamp housing is preferably generally U-shaped and has an interior channel. The interior channel is tapered such that one end of the interior channel is wider than a second end. The wedge is located in the interior channel of the clamp housing and in between one side of the glass door and an inner surface of the clamp housing. The wedge is also tapered. The set screw is located at one end of the clamp housing and is used to urge the wedge from that end toward the other end. As the wedge moves away from the wider end of the interior channel, this causes the wedge to move closer to the glass door and apply greater pressure against the glass door and an interior side of the clamp housing. This is because the tapered interior channel forces the wedge away from one side of the clamp housing toward the other side. A base plate having a raised portion may also be used. The raised portion extends at least slightly above a surface of the base plate and mates with a recessed portion of a clamp housing.

20 Claims, 6 Drawing Sheets

U.S. PATENT DOCUMENTS

| | | | | | |
|---|---|---|---|---|---|
| 4,090,274 | A | | 5/1978 | Bourgeois | |
| 4,200,956 | A | * | 5/1980 | Ullman, Jr. | 16/235 |
| 4,209,946 | A | * | 7/1980 | Akai | 49/390 |
| 4,513,474 | A | * | 4/1985 | Watabe | 16/243 |
| 4,787,120 | A | | 11/1988 | Haigh | |
| 4,799,290 | A | * | 1/1989 | Lautenschlager, Jr. | 16/237 |
| 4,897,889 | A | | 2/1990 | Baus | |
| 5,265,311 | A | | 11/1993 | Gard | |
| 5,417,272 | A | | 5/1995 | Marlowe et al. | |
| 5,588,181 | A | * | 12/1996 | Sutton | 16/252 |
| 5,613,276 | A | * | 3/1997 | Franz | 16/229 |
| 5,867,869 | A | | 2/1999 | Garrett et al. | |
| 5,908,064 | A | | 6/1999 | Bruce | |
| 6,021,547 | A | * | 2/2000 | Stagoll | 16/105 |
| 6,035,460 | A | * | 3/2000 | Borter | 4/607 |
| 6,070,294 | A | * | 6/2000 | Perkins et al. | 16/252 |
| 6,161,255 | A | | 12/2000 | Garrett | |
| 6,618,871 | B2 | * | 9/2003 | Kopacz et al. | 4/607 |
| 6,643,898 | B1 | * | 11/2003 | Cameron et al. | 16/382 |

* cited by examiner

FRAMELESS GLASS DOOR HINGE

FIELD OF THE INVENTION

The present invention generally relates to hinges for glass doors. More particularly, the invention concerns a frameless glass door hinge that does not require holes or cut-out portions in the glass panel for mounting the hinge to the panel.

BACKGROUND OF THE INVENTION

Pivoting door hinges are well known for use with shower doors. A known pivot hinge assembly can include a door mount with a protruding post that pivotally connects a mounting portion to a receiving aperture in a wall, soffit, header or other stationary element. Pivot hinge assemblies frequently require fewer hardware elements, as compared to fully framed door hinges, thereby enabling a larger portion of the shower door to be visible. In that way they can provide an aesthetically pleasing visual appearance in shower door assemblies. Some known pivot hinge assemblies also are self-centering. A self-centering hinge assembly biases a mounted shower door towards a generally closed position. A disadvantage of a known pivot hinge assembly used with shower doors is that holes and/or notches are required to be cut into the glass door panel in order to mount the door mounting portion of the hinge assembly to the shower door. Furthermore, boring, notching or otherwise mechanically altering a glass door panel in this way can impair the structural strength of the panel, cause stress points or otherwise weaken the panel, and also impact aesthetic appeal. A further disadvantage is that this increases fabrication expense and time.

One example of a self-centering pivot door hinge is illustrated in U.S. Pat. No. 6,643,898. A door receiving channel member is provided having a generally rectangular bottom and a base plate member is provided having an alignment channel defined by a pair of generally parallel ridge members. The channel member bottom is pivotable from a centered orientation within the alignment channel between the ridge members to a non-centered orientation wherein the channel member rests upon the ridge members. Set screws are also illustrated on the door panel receiving channel, received within apertures in the door panel receiving channel and can be accessible along one of the inside of the shower door or outside, depending on the orientation of the channel member in assembly. The set screws apply lateral pressure to a compression plate that secures the door to the door receiving channel member (i.e. the pressure is applied by the set screws generally vertical to the door panel.

Accordingly, there is a need for a pivot door hinge device and system that requires a reduced number of externally visible mounting screws, has a base plate without a plural ridge members or an alignment channel defined by ridge members and is self-centering and provides an aesthetically pleasing appearance.

SUMMARY OF THE INVENTION

The present invention alleviates to a great extent the disadvantages of the known pivot hinges by providing a pivot door hinge assembly having a longitudinally applied wedge mounting system and optionally a single ridge base plate. In a preferred embodiment, the present invention provides a frameless glass door hinge that uses a wedge clamp assembly to secure the hinge to the shower door. In a preferred embodiment, set screws applying lateral pressure are not required nor are holes or notches required in the door panel.

The pivot door hinge assembly generally includes bottom and top hinge assemblies, the bottom hinge assembly including a bottom clamp housing having a pivot post, a longitudinally oriented set screw, a wedge, a base plate having connector portions and a raised center portion. An exterior surface of the clamp housing may include a recessed portion that mates with a protruding portion of the base plate. A top hinge assembly may be used to secure the upper end of a door panel to a wall-mounting bracket, header, soffit or other arrangement pivotally or hingedly mounting the upper area of the door panel to the corresponding stationary element, such as a wall or enclosure. The top hinge assembly includes a top clamp housing having a pivot post, a longitudinally oriented set screw and a wedge. Although there are top and bottom hinge assemblies provided in the present invention, it should be understood that the invention may be practiced with optionally only one of a top or a bottom hinge. In such an embodiment, another type of hinge may be used in conjunction with one of the hinges of the present invention.

The clamp housing preferably includes an interior channel, such as a u-shaped channel defined by clamp walls and a laterally extended bottom, upon which a door panel can rest. Preferably, the interior channel is longitudinally tapered such that one end of the interior channel is wider than a second end of the interior channel. In mounting the door panel to the clamp housing a longitudinally tapered wedge is positioned in the channel between an inner surface of the clamp housing and one side of the glass door.

The set screw is located at one end of the clamp housing and is used to urge the wedge from that end in the longitudinal direction. Preferably, the thicker end of the wedge is located at the wider end of the interior channel and adjacent the set screw such that as the wedge is urged longitudinally forward, the force exerted by the wedge on the door panel increases, thereby mounting the door panel fixedly within the interior channel. The wedge is urged longitudinally forward by rotating the set screw, urging the wedge to move away from the wider end of the interior channel. This causes the wedge to exert lateral pressure on the door panel and the opposite inner side of the clamp housing, because the tapered inner side of the interior channel forces the wedge away from one side of the mounting bracket toward the other side. The set screw may be rotated until, for example, sufficient pressure is deemed to be applied by the wedge such that the glass door is securely attached to the hinge assembly.

According to one embodiment of the present invention, the pivot door hinge assembly may also include a base plate having a raised portion (also referred to as a "ridge" on the upper surface. Connecting portions and the ridge preferably are located on opposite sides of the base plate. For example, the connecting portions may be located on a bottom side and the raised portion may be located on a top side. The connecting portions may be used to connect the base plate to a support, such as a footer or mounting assembly. The raised portion may be used to enable the frameless glass door hinge to be self-centering. The raised portion may be a ridge that extends at least slightly above a surface of the base plate. The ridge preferably mates with a corresponding recess (or raised portion) on the lower surface of the clamp housing. The base plate is preferably installed such that when the shower door is in a closed position, the raised portion mates with the corresponding recessed portion either on the mounting clamp or hinge, or the door frame, as the door drops down into an "at rest" position. This maintains the shower door alignment in the closed position. Thus, when opening the shower door, at least some force is required to enable recess walls to overcome the ridge, hence opening the door. During closing and upon passing one side of the recessed portion and almost reaching the other side of the recessed portion, the raised portion is received in the recessed portion and maintains the shower door in that position (provided excessive force is not used to close the shower door) creating a self-centering mechanism.

Accordingly, it is seen that a self-centering pivoting glass door hinge is provided with a friction-based wedge locking mechanism, in which laterally applied pressure via set screws is not required, and thereby an enhanced visual appearance, enhanced durability and decreased manufacturing and assembly complexity are achieved. These and other features and advantages of the present invention will be appreciated from review of the following detailed description of the invention, along with the accompanying figures in which like reference numbers refer to like parts throughout.

DETAILED DESCRIPTION OF THE INVENTION

In the following paragraphs, the present invention will be described in detail, and by way of example with reference to the accompanying drawings. Throughout this description, the preferred embodiments and examples shown should be considered as exemplars, rather than as limitations on the present invention. As used herein, the "present invention" refers to any one of the embodiments of the invention described herein, and any equivalents. Furthermore, reference to various aspects of the invention throughout this document does not mean that all claimed embodiments or methods must include the referenced aspects.

Figure 1:
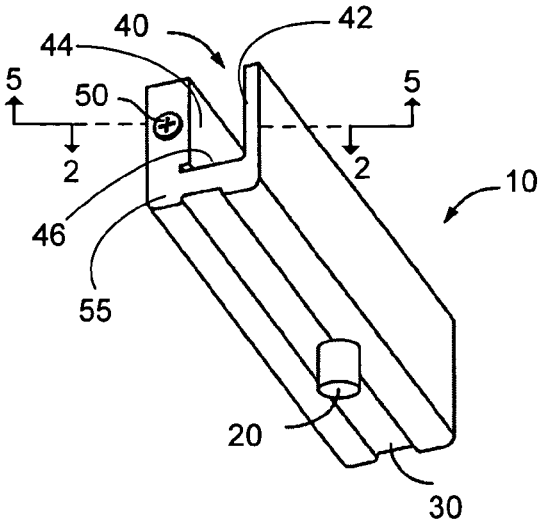
FIG. 1 is a perspective view of a clamp housing of a frameless shower door hinge in accordance with one embodiment of the present invention.
Figure 2:
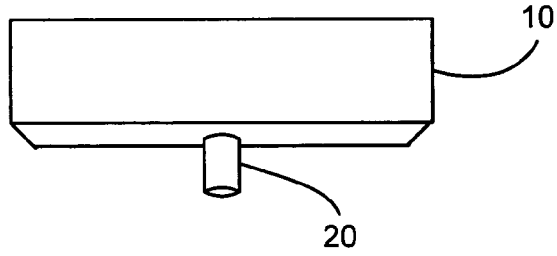
FIG. 2 is a side view of a clamp housing of a frameless shower door hinge, as illustrated in FIG. 1.

FIG. 1 illustrates a clamp housing 10 of a pivot door hinge assembly according to one embodiment of the present invention. The clamp housing may be used with one or both of a top hinge assembly or a bottom hinge assembly. The clamp housing 10 includes a protruding mounting post 20 that may be used to pivotally mount the clamp housing 10 to a corresponding recess. The mounting post 20 preferably is provided on an exterior side 25 of the clamp housing 10. For a bottom clamp, the exterior side 25 from which the mounting post 20 protrudes would be positioned on the bottom exterior side of the clamp housing 10 while on a top clamp the mounting post 20 would be on the top.

In a top hinge assembly (illustrated in greater detail in FIGS. 15-17), the corresponding recess may be in a header, wall block or soffit sleeve, or any other support apparatus with sufficient structural strength to support the door panel via the top hinge assembly. In a bottom hinge assembly, the corresponding recess may be included in a base plate 120 having a matching recess 125. In such an embodiment, the base plate is mounted to the support in any desired fashion. The mounting post 20 is adapted to fit a receiving recess in the support or alternatively the recess 125 of the base plate 120, which in turn may be mounted to the support.

A longitudinally extended recess 30 may also be provided on the exterior side 25 of the clamp housing 10. In a bottom clamp housing, it is preferred that a recess 30 is available to provide a self-centering mechanism in combination with the base plate 120 having a matching protruding ridge 140. It should be noted that an opposite embodiment may be practiced in which the bottom clamp housing 10 has a longitudinally extending protrusion while the base plate 120 has the matching recess. Any combination of aligning recesses and matching protrusions of any desired profile may be used on the bottom clamp exterior side 25 and matching base plate such 120 such that the assembly can be self-aligning and/or have fluid diverting properties. Although the figures and following discussion relate specifically to the preferred embodiment in which a single longitudinally extended recess 30 is provided on the bottom clamp housing 10 and matching protrusion(s) or ridge(s) are provided on the base plate 120, it should be understood that the alternatives also may be practiced.

The clamp housing 10 preferably includes a longitudinally extending interior channel 40, such as a generally U-shaped defined by longitudinally extending side interior clamp walls 42, 44 and longitudinally extending bottom interior clamp wall 46. The interior channel 40 is adapted to receive a door panel 90, such as for example a shower door panel, or any other desired door panel. In assembly, the clamp 10 (and more particularly the interior channel 40) is positioned on an edge portion 210 (such as a top or bottom edge) of the door panel. The clamping assembly acts to secure the door panel 90 to the clamp housing 10 as discussed more fully below, and illustrated in the figures.

A set screw 50 is provided on at least one end of the clamp housing 10, referred to as the set screw end 55. The set screw 50 abuts one end of a wedge 70 positioned within the channel 40, between the door panel and one of the interior clamp walls 42, 44. In the illustrated embodiment, the wedge 70 is positioned adjacent wall 44. In operation, the set screw 50 urges the wedge longitudinally from one end of the mounting bracket 10 towards the other end (described in further detail below). The set screw 50 may be any known type of screw, such as a threaded screw and can be turned using a tool.

Figure 4:
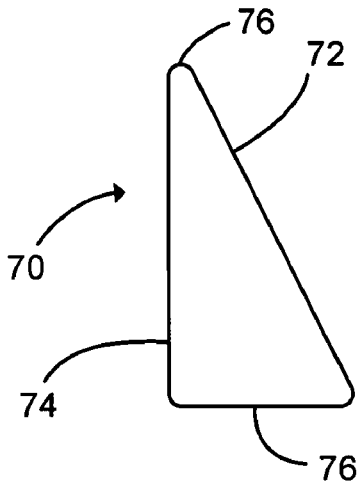
FIG. 4 is a cross-sectional view of the wedge clamp component of the clamp housing, as illustrated in FIG. 3.

In one embodiment, as illustrated in FIG. 4, the interior channel 40 of the clamp housing 10 has at least one angled wall. In the illustrated embodiment, an angle is depicted in wall 44 in which the wall is longitudinally angled wherein the width of the channel 40 is wider at a first longitudinal end 46 than at a second end 48. The angled portion of the wall 44 in some embodiments extends the entire length of the wall 44 from one end 46 to the other 48 and in the illustrated embodiment, the angled portion starts at an intermediate location 49 between the first 46 and second 48 ends forming a longitudinally angled or tapered portion 60. As the interior channel 40 extends longitudinally from one end, preferably the end at which the set screw 50 is located, a width of the interior channel 40 decreases coinciding with the tapered portion 60.

Figure 5:
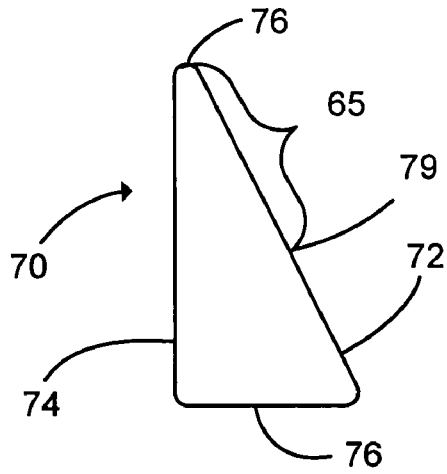
FIG. 5 is a cross-sectional view of the wedge clamp component of the clamp housing with a longitudinally angled lateral wall, as illustrated in FIG. 3.
Figure 6:
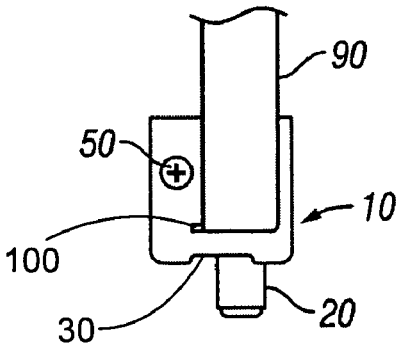
FIG. 6 is an end view of a clamp housing of a frameless shower door hinge in accordance with one embodiment of the present invention.

In a preferred embodiment, the wedge 70 is positioned between a door panel 90 and a wall 44 of the clamp housing 10. The wedge includes an angled section or has an angle running its entire tapered section preferably located inbetween a glass panel (shown in FIG. 6) of a shower door and the tapered portion 60. In an embodiment, protective member 80 is positioned between the wedge and the door panel 90. Preferably, the wedge 70 includes an angled lateral wall 72, and in a preferred embodiment, the angle of the wall 72 is generally the same as the angle of the corresponding angled wall 44 of the clamp housing 10. The opposite lateral side 74 of the wedge preferably is substantially straight running longitudinally from one from longitudinal end of the wedge 76 to the other 78. In assembly of the clamp assembly, the wider end 76 of the wedge 70 is positioned at the set screw 50 end of the clamp housing 10 such that the set screw either directly or indirectly engages the wider end 76. Driving the wedge longitudinally within the channel 40 causes the angle of the wedge wall 72 and channel wall 44 to effectuate a lateral movement of the wedge towards the interior of the channel 40, puffing lateral pressure on the door panel 90 and optional protective member 80, thereby providing pressure clamping retaining the clamp housing 10 in a fixed relation to the door panel 90. Preferably, the wedge 70 extends at least along a portion of the interior channel 40. The angled portion of the wall 72 in some embodiments extends the entire length of the wedge 70 from one end 76 to the other 78 and in the illustrated embodiment, the angled portion starts at an intermediate location 79 between the ends 76, 78 forming a longitudinally angled or tapered portion 65 (as shown in FIG. 5). As the interior channel 40 extends longitudinally from one end, preferably the end at which the set screw 50 is located, a width of the interior channel 40 decreases coinciding with the tapered portion 60.

According to one embodiment of the present invention, the set screw 50 abuts one end of the wedge 70, preferably the wider end 76. As the set screw 50 is rotated in a direction that causes it to engage (such as clockwise), the set screw 50 pushes the wedge 70 further into the interior channel 40 causing it to engage the angled portion 60 of wall 44. This causes the wedge 70 to increase an amount of pressure exerted on the door panel 90 and the clamp housing 10, the pressure being transmitted via the wedge 70 and the optional pad 80 between the door panel 90 and wall 44 of the clamp housing and between door panel 90 and the laterally opposed wall 42 of the clamp housing (via an optional pad as well). By increasing the pressure exerted on the glass panel and the clamp housing 10, the glass panel is more securely held by the clamp housing 10. Similarly, by rotating the set screw 50 in a direction that causes it to disengage (such as counter-clockwise), the wedge can also disengage allowing the clamp housing 10 to be removed from the door panel 90.

In one embodiment, the interior wall of the clamp member that engages the wedge 70 (such as wall 44) includes a recessed portion 75 into which the wedge 70 can be positioned with its engagement surface 72 positioned adjacent the recessed portion 75. This allows for easier positioning of the wedge 70 during assembly of the clamp housing, and enhances retention of that positioning.

According to one embodiment of the present invention, the longitudinally extending protective member 80 is positioned between the door panel 90 and the wedge 70. The protective member 80 may be any suitable material that provides cushioning and/or enhanced frictional engagement, such as example, a rubber, a polymeric material (plastic) or cellulosic material, or other material that may protect the glass panel from scratching or otherwise being damaged by the wedge member 70, and/or which provides enhanced frictional engagement. The protective member 80 may also be sized to be positioned not only between the wedge 70 and the door panel but also between any portions of the surface 44 that does not overlap with the wedge and the door panel 90. Other protective members 80 may be positioned between any other surface of the channel 40 and the door panel 90, such as between surfaces 42 and 46 and the door panel. Although separate protective members 80 may be used for one or more of the surfaces, a single protective member 80 may be provided, such as a U or L shaped member 80 that longitudinally extends between one or more of the surfaces 74, 42, 44, 46 etc. and the door panel 90.

In one embodiment of the present invention, the clamp assembly is self centering. In this embodiment, the clamp housing 10 is used in conjunction with a matching base plate 120. It should be noted that although base plate 120 is preferred, that any mounting assembly or self-centering mechanism can be used. In the preferred embodiment, a bottom hinge assembly is provided in which the base plate includes a raised ridge 140 (also called protruding portion) running longitudinally between edges 122 and 124 generally corresponding to the notch 30 in the clamp housing 10. The mounting post 20 is adapted to fit a receiving recess 125 of the base plate 120, which in turn may be mounted to a support. The base plate 120 can be mounted to the support by any desired fashion, such as using fasteners (like screws, bolts etc.), adhesive or other mechanical mounts such as mounting posts 130. The mounting posts 130 may be used to mount the base plate to a lower support such as, for example, a footer, for a shower door. In assembly, the base plate 120 and the clamp housing 10 of the bottom clamp assembly is mounted to the door panel 90 such that the mounting post 20 of the clamp housing 10 can be inserted into the receiving recess 125 of the base plate. In the illustrated embodiment, the receiving recess 125 is formed in the surface of the base plate and extends downwards into one of the mounting posts 130.

The protruding portion 140 may include tapered ends 145 facilitating smoother engagement with the surfaces of the notch 30 as the door is opened and closed. By providing mating portions on the base plate 120 and the clamp housing, this creates a self-centering shower door. This is because when the base plate 120 and the shower door are aligned, the protruding portion 140 and the recessed portion mate. This causes the shower door to be maintained in a predetermined position, preferably a closed position, unless a force is exerted sufficient to overcome the engagement of the notch 30 and ridge 140. In operation, as the shower door is moved from an open position to a closed position, the tapered edges 145 of the protruding portion 140 and the recessed portion 30 (which also optionally has an optional angle at its ends matching the tapered edges 145) cause the door panel 90 and its mounted clamp housing 10 door to move upward slightly as they overcome the protruding portion 140. As the door panel is moved from an open to a closed position, the opposite occurs, namely the recessed portion 30 moves back into position over the raised portion 140. Once the recessed portion 30 slides over the protruding portion 140, the recessed portion 30 and protruding portion 140 mate and cause the shower door to drop slightly lower into its relaxed position, and it is retained in that position unless a force sufficient to move the recessed portion 30 back over the edges of the protruding portion 140 is exerted on the door panel 90 (or clamp housing 10). Otherwise, the shower door maintains in the position at which the recessed portion 30 and the protruding portion 140 are mated.

An optional base adapter 150 can be provided and used in conjunction with the base plate 120 in order to bias the door panel 90 into a generally closed position in which the recess 30 and ridge 140 mate. The base adapter 150 is preferably wedge-shaped with the taper running laterally from edge 162 to 164. This serves to impart a corresponding angle to the base plate 120 mounted on the base adapter 150. This serves to provide a biasing orientation in which the door panel 90 is biased to move in the direction of the narrower edge of the taper. Preferably the taper is oriented to bias the door panel 90 to a closed position. Thus by using the base adapter 150, the base plate 120 also is angled and a gravitational bias is imparted on the clamp housing 10, which rides on it in operation. Alternatively, where desired, the base adapter 150 can be used to level the base plate 120 if the support surface is uneven.

Figure 3:
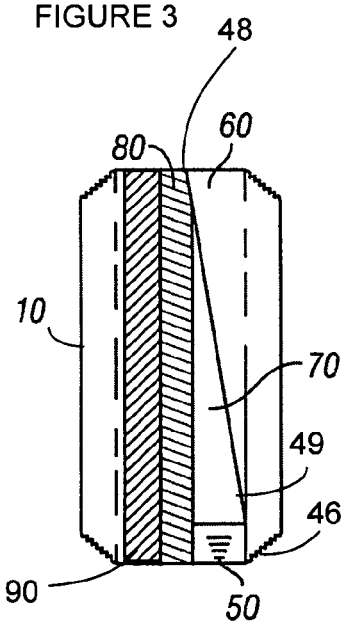
FIG. 3 is a cross-sectional view of a clamp housing of a frameless shower door hinge in accordance with one embodiment of the present invention, taken along line 2-2 as illustrated in FIG. 1.
Figure 7:
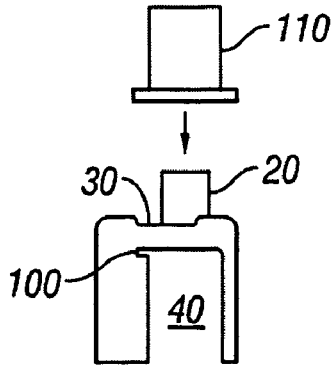
FIG. 7 is an end view of a clamp housing of a frameless shower door hinge in accordance with one embodiment of the present invention.
Figure 8:
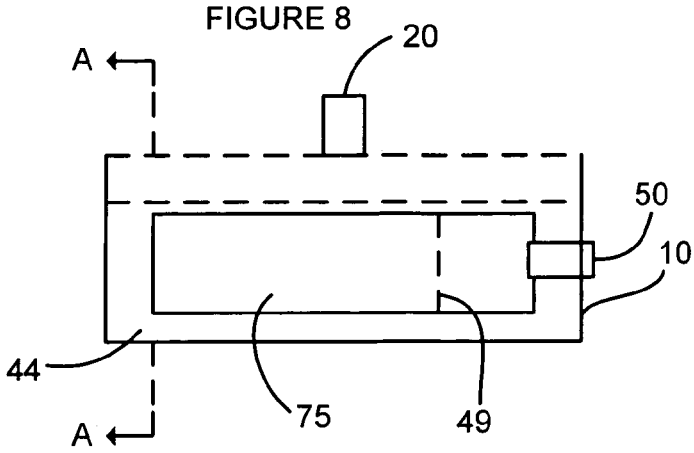
FIG. 8 is a side view of a clamp housing of a frameless shower door hinge in accordance with one embodiment of the present invention, as illustrated in FIG. 1.
Figure 9:
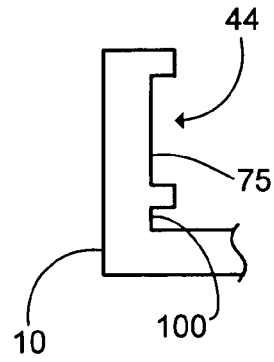
FIG. 9 is an end view of a clamp housing illustrating the recessed portion of the frameless shower door hinge in accordance with one embodiment of the present invention.
Figure 10:
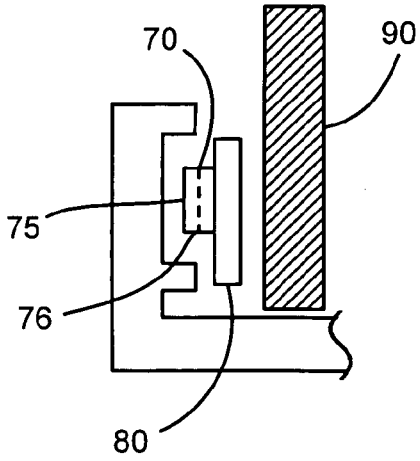
FIG. 10 is an end view of a clamp housing illustrating the connection to a protective member and door panel of the frameless shower door hinge in accordance with one embodiment of the present invention.
Figure 11:
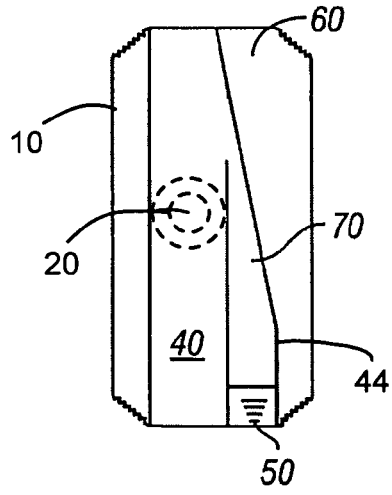
FIG. 11 is a bottom view of a clamp housing of a frameless shower door hinge in accordance with one embodiment of the present invention, taken along line 5-5 as illustrated in FIG. 1.
Figure 12:
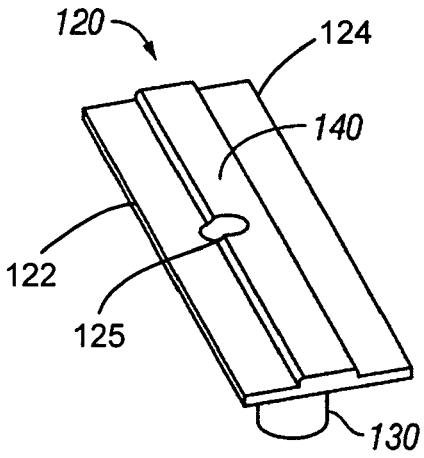
FIG. 12 is a top view of a base plate of a frameless shower door hinge in accordance with one embodiment of the present invention.
Figure 13:
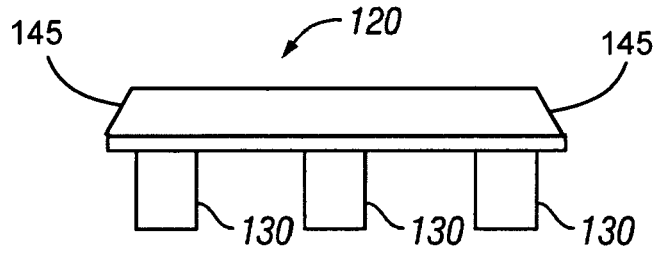
FIG. 13 is a side view of a base plate of a frameless shower door hinge in accordance with one embodiment of the present invention.
Figure 14:
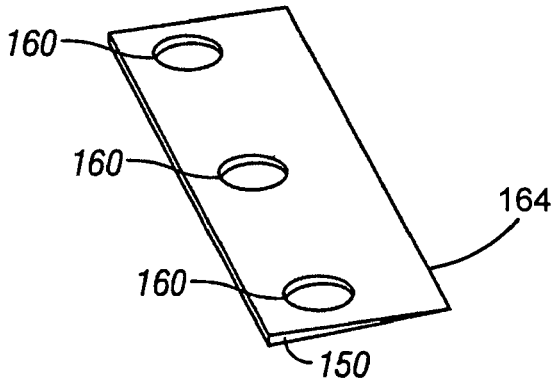
FIG. 14 is a top perspective view of an adapter plate of a frameless shower door hinge in accordance with the present invention.

FIG. 7 is a view of another end of the clamp housing 10 shown in FIG. 3. FIG. 7 illustrates the mounting post 20 and the recessed portion 30 and interior channel 40 of the clamp housing 10. According to one embodiment of the present invention, a machine groove 100 is provided along one side of a top portion of the interior channel 40. The machine groove 100 may be used to delineate the tapered portion 60 of the interior channel 40. FIG. 7 also shows an optional bushing 110 that may be used with the clamp housing 10. The optional bushing 110 may be used to more securely fit the mounting post 20 into the receiving aperture of the support. The optional bushing 110 may be used, for example, if a width of the receiving aperture of the support is unacceptably larger than a width of the mounting post 20.

Figure 15:
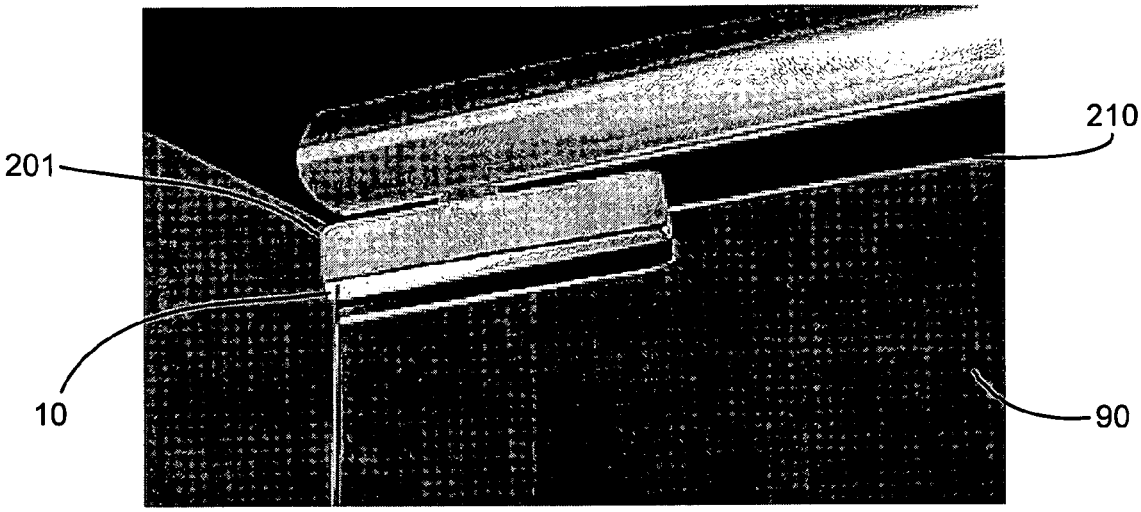
FIG. 15 is a front perspective view of a header mounting structure for the frameless shower door top hinge assembly in accordance with one embodiment of the present invention.
Figure 16:
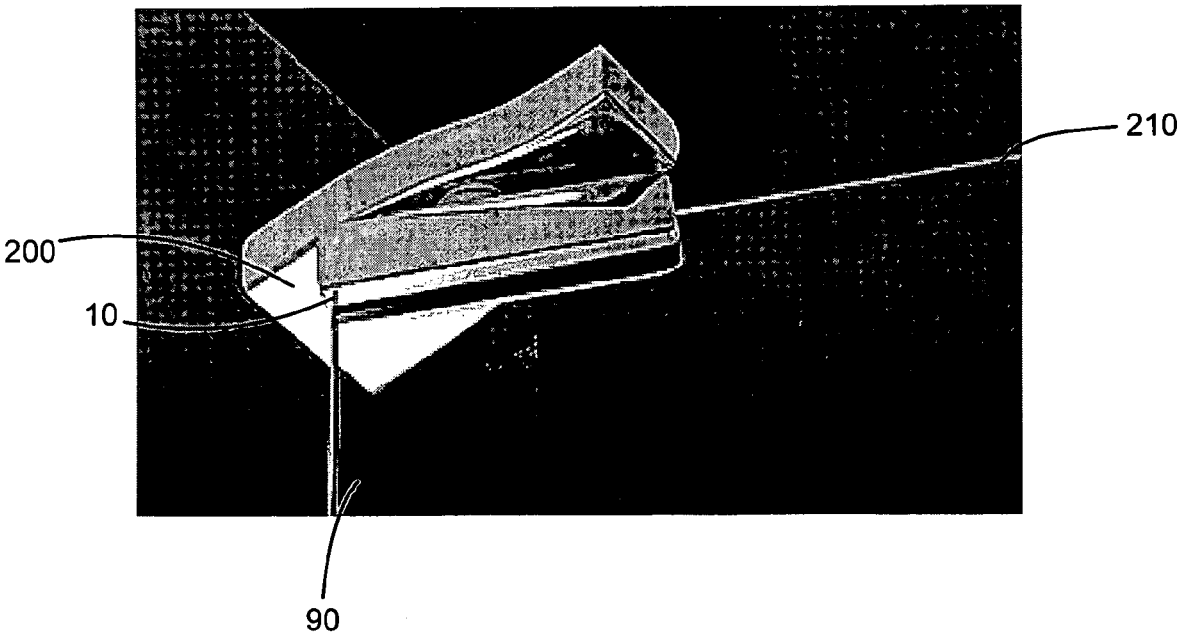
FIG. 16 is a front perspective view of the wall block mounting structure for the frameless shower door top hinge assembly in accordance with one embodiment of the present invention; and, FIG. 17 is a front perspective view of a soffit sleeve mounting structure for the frameless shower door top hinge assembly in accordance with one embodiment of the present invention.
Figure 17:
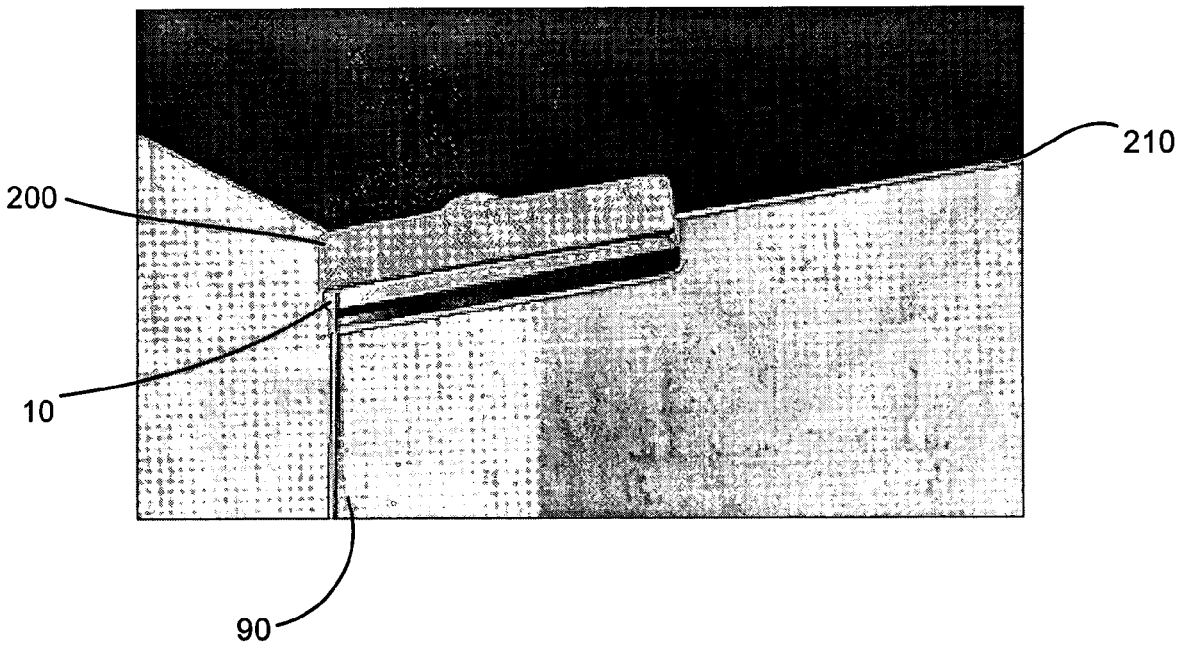

Various mounting structures are illustrated in FIGS. 15-17 in which a mounting assembly 200 is used to mount a door panel 90 to a fixed mounting member. In FIG. 15, a header mount is illustrated. In FIG. 16, a wall block mount is illustrated. In FIG. 17, a soffit sleeve mount is illustrated. Any other suitable mounting structure also can be used wherein the clamp housing 10 is securely and rotatably mounted to a stationary mounting element, such as via mounting post 20.

Thus, it is seen that a pivot door hinge assembly is provided. One skilled in the art will appreciate that the present invention can be practiced by other than the preferred embodiments which are presented in this description for purposes of illustration and not of limitation, and the present invention is limited only by the claims that follow. It is noted that equivalents for the particular embodiments discussed in this description may practice the invention as well.

What is claimed is:

1. A door hinge assembly comprising:

a clamp housing having an interior channel defined by a base and lateral walls extending from the base, one of the lateral walls having an angled interior surface extending longitudinally within the interior channel and spaced apart from and angled relative to the other lateral wall, the interior channel being capable of receiving a door and a wedge member;

the wedge member movably positioned within the interior channel adjacent the angled interior surface, the wedge member being longitudinally moveable within the interior channel; and a locking mechanism contained within the one of the lateral walls of the interior channel, operation of the locking mechanism urging the wedge member longitudinally within the interior channel.

2. The door hinge assembly of claim 1 wherein the locking mechanism includes a set screw.

3. The door hinge assembly of claim 1 further comprising a protective member positioned between the wedge member and a door panel.

4. The door hinge assembly of claim 1 wherein the wedge member is positioned between the clamp housing and a glass panel of a shower door.

5. The door hinge assembly of claim 1 wherein the clamp housing is substantially U-shaped.

6. The door hinge assembly of claim 1 wherein the clamp housing comprises at least one mounting post.

7. The door hinge assembly of claim 1 further comprising a bushing.

8. The door hinge assembly of claim 1 further comprising a machine groove.

9. The door hinge assembly of claim 1 wherein the clamp housing has a recessed portion along an exterior side of the clamp housing.

10. A pivot door hinge assembly comprising:

an upper clamp housing having an interior channel;

a lower clamp housing having an interior channel, the interior channel of at least one of the upper clamp housing or lower clamp housing being defined by a base and lateral walls extending from the base, one of the lateral walls having an angled interior surface extending longitudinally within the interior channel and spaced apart from and angled relative to the other lateral wall, the interior channel being capable of receiving a door and a wedge member;

a base plate;

the wedge member provided in at least one of the upper clamp housing or the lower clamp housing and longitudinally translatable therein, the wedge member engaging the angled interior surface; and a base adapter provided in the lower clamp housing such that the base adapter is usable in conjunction with the base plate to bias the door panel into a generally closed position.

11. The pivot door hinge assembly of claim 10 further comprising a set screw contained in the one of the lateral walls and causing the interference fit.

12. The pivot door hinge assembly of claim 10 further comprising a protective member.

13. The pivot door hinge assembly of claim 10 wherein the wedge member is positioned between the angled protrusion and a glass panel of a shower door.

14. The pivot door hinge assembly of claim 10 wherein the at least one of the upper clamp housing and the lower clamp housing is substantially U-shaped.

15. The pivot door hinge assembly of claim 10 wherein the at least one of the upper clamp housing and the lower clamp housing comprises at least one mounting post.

16. The pivot door hinge assembly of claim 10 further comprising a bushing.

17. The pivot door hinge assembly of claim 10 further comprising a machine groove.

18. The pivot door hinge assembly of claim 10 wherein the at least one of the upper clamp housing and the lower clamp housing has a recessed portion along an exterior side of the clamp housing.

19. The pivot door hinge assembly of claim 10 wherein the base plate comprises a protruding portion.

20. The pivot door hinge assembly of claim 10 further comprising a base adapter.

* * * * *